US005642567A

United States Patent [19]

Lin

[11] Patent Number: 5,642,567

[45] Date of Patent: Jul. 1, 1997

[54] EMERGENCY ESCAPE APPARATUS FOR USE IN A CAR

[75] Inventor: Yung-Fa Lin, Taipei Hsien, Taiwan

[73] Assignee: Jia Shin Industrial Co., Ltd., Pan-Chiao, Taiwan

[21] Appl. No.: 553,899

[22] Filed: Nov. 6, 1995

[51] Int. Cl.[6] ..... B25F 1/00

[52] U.S. Cl. ..... 30/366; 7/100; 7/158

[58] Field of Search ..... 30/358, 359, 366, 30/368, 123, 151, 152, 162; 7/158, 100; 362/119, 120

[56] References Cited

U.S. PATENT DOCUMENTS 5,251,351 10/1993 Klotz ..... 7/100

5,421,460 6/1995 Bosshard ..... 7/158 X

*Primary Examiner*—Hwei-Siu Payer

*Attorney, Agent, or Firm*—Foley & Lardner

[57] ABSTRACT

An emergency escape apparatus for use in a car includes an elongated body and a mounting seat for receiving the elongated body. The elongated body has a head portion and a handle portion which is connected integrally to the head portion. The elongated body further has a channel which extends toward and which is communicated with the exterior of the elongated body. A rigid striking member is fixed to the head portion and has a tapered end which extends out of the head portion. A needle member is received slidably in the channel of the elongated body and has a sharp end which is extendible from and retractable into the elongated body.

6 Claims, 5 Drawing Sheets

EMERGENCY ESCAPE APPARATUS FOR USE IN A CAR

BACKGROUND OF THE INVENTION

1. Field of the Invention

This invention relates to an emergency escape apparatus, more particularly to an emergency escape apparatus for use in a car.

2. Description of the Related Art

When an accident happens, a driver may be prevented from escaping from a car because of the expanded air bag, the damaged door windows which are unable to be rolled down, the damaged doors which are unable to be opened, the damaged safety belt which is locked on the seat, etc. The driver may lose his life if he can not escape from the damaged car in time.

SUMMARY OF THE INVENTION

Therefore, a main object of the present invention is to provide an emergency escape apparatus which can help the driver to escape from a damaged car in time when an accident occurs.

The emergency escape apparatus according to the present invention is to be used in a car and comprises an elongated body having a head portion and a handle portion which is connected integrally to the head portion. The elongated body has a channel which extends toward and which is communicated with the exterior of the elongated body. A rigid striking member is fixed to the head portion and has a tapered end which extends out of the head portion. A needle member is received slidably in the channel of the elongated body and has a sharp end which is extendible from and retractable into the elongated body. Therefore, the driver can break the windows by means of the striking member in order to get out of the car through the windows. Also, the driver can deflate the expanded air bag by means of the needle member.

Preferably, the elongated body has a groove which is formed in the external face thereof and which is communicated with the channel, and a push member which is connected to the needle member and which is mounted slidably in the groove. Therefore, the sharp end of the needle member can extend out from the elongated body by pushing the push member along the groove.

In a preferred embodiment, a notch is formed between the head portion and the handle portion. A blade member is fixed in the elongated body near the notch and has a cutting edge which extends into the notch in order to cut the safety belt. The handle portion has a receiving hole formed therein, an opening which communicates the receiving hole and the exterior of the elongated body, and an illuminating device mounted in the receiving hole. The illuminating device has a light-emitting member which extends into the opening. Therefore, the apparatus of the present invention can be used as a flashlight. In addition, a whistle is mounted removably in a cavity of the handle portion in order to enable the user to attract other people's attention for help.

In the preferred embodiment, the emergency escape apparatus further comprises a mounting seat for receiving removably the handle portion therein. The mounting seat has a fixing unit for affixing the mounting seat to a predetermined position of the car.

BRIEF DESCRIPTION OF THE DRAWINGS

Other features and advantages of this invention will become apparent in the following detailed description of the preferred embodiment of this invention with reference to the accompanying drawings, in which.

DETAILED DESCRIPTION OF THE PREFERRED EMBODIMENT

Figure 1:
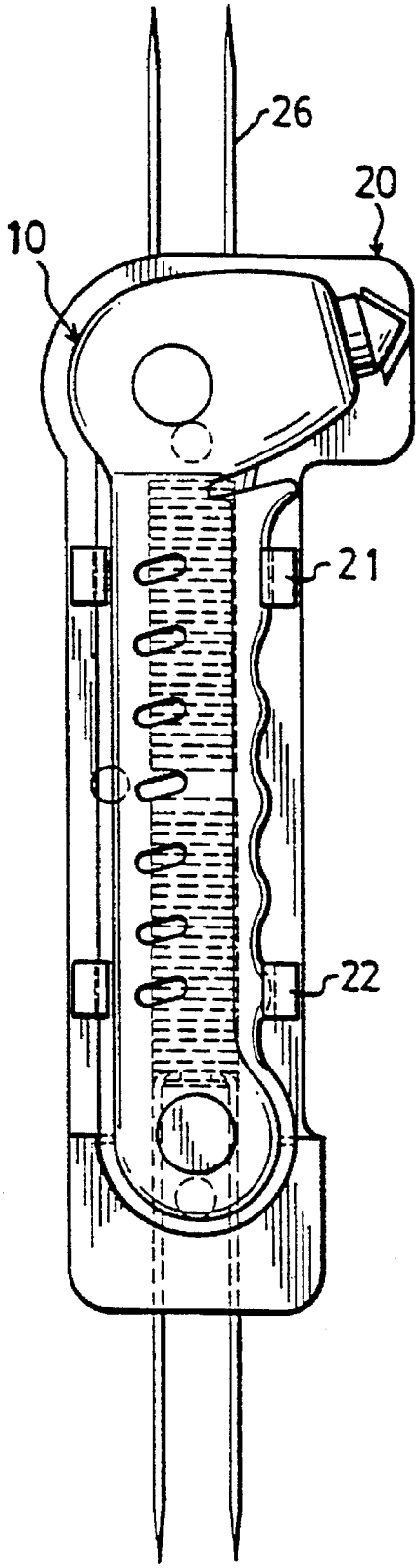
FIG. 1 is a side view of a preferred embodiment of an emergency escape apparatus according to the present invention.

Referring to FIG. 1, a preferred embodiment of an emergency escape apparatus for use in a car is shown to comprise an elongated body 10 and an elongated mounting seat 20 for receiving the elongated body 10 therein.

Figure 2:
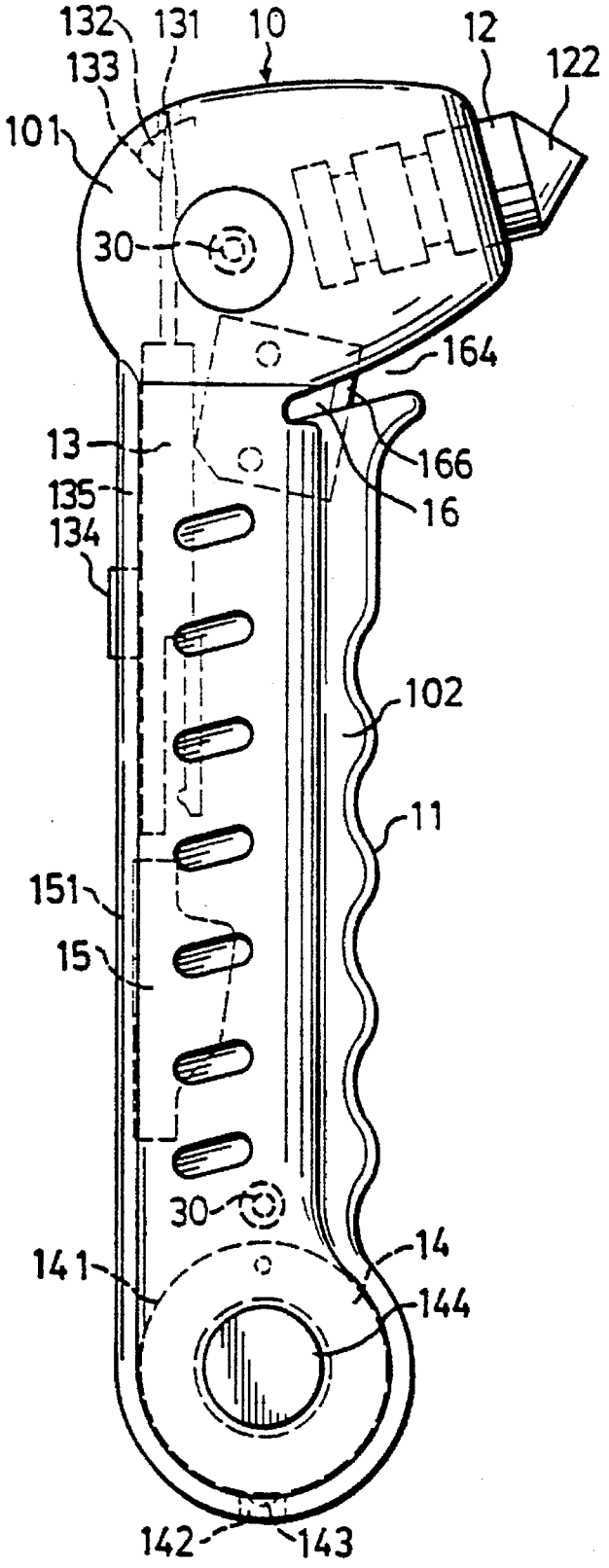
FIG. 2 is a side view of the elongated body of the preferred embodiment of the emergency escape apparatus according to the present invention.

Referring to FIG. 2, the elongated body 10 is made of a light plastic material and consists of two half portions which are connected detachably to one another by screws 30. The elongated body 10 has an enlarged head portion 101 and a handle portion 102 which is connected integrally to the head portion 101. The handle portion 102 has a corrugated side 11 to facilitate gripping of the handle portion 102 by the user's hand.

Figure 3:
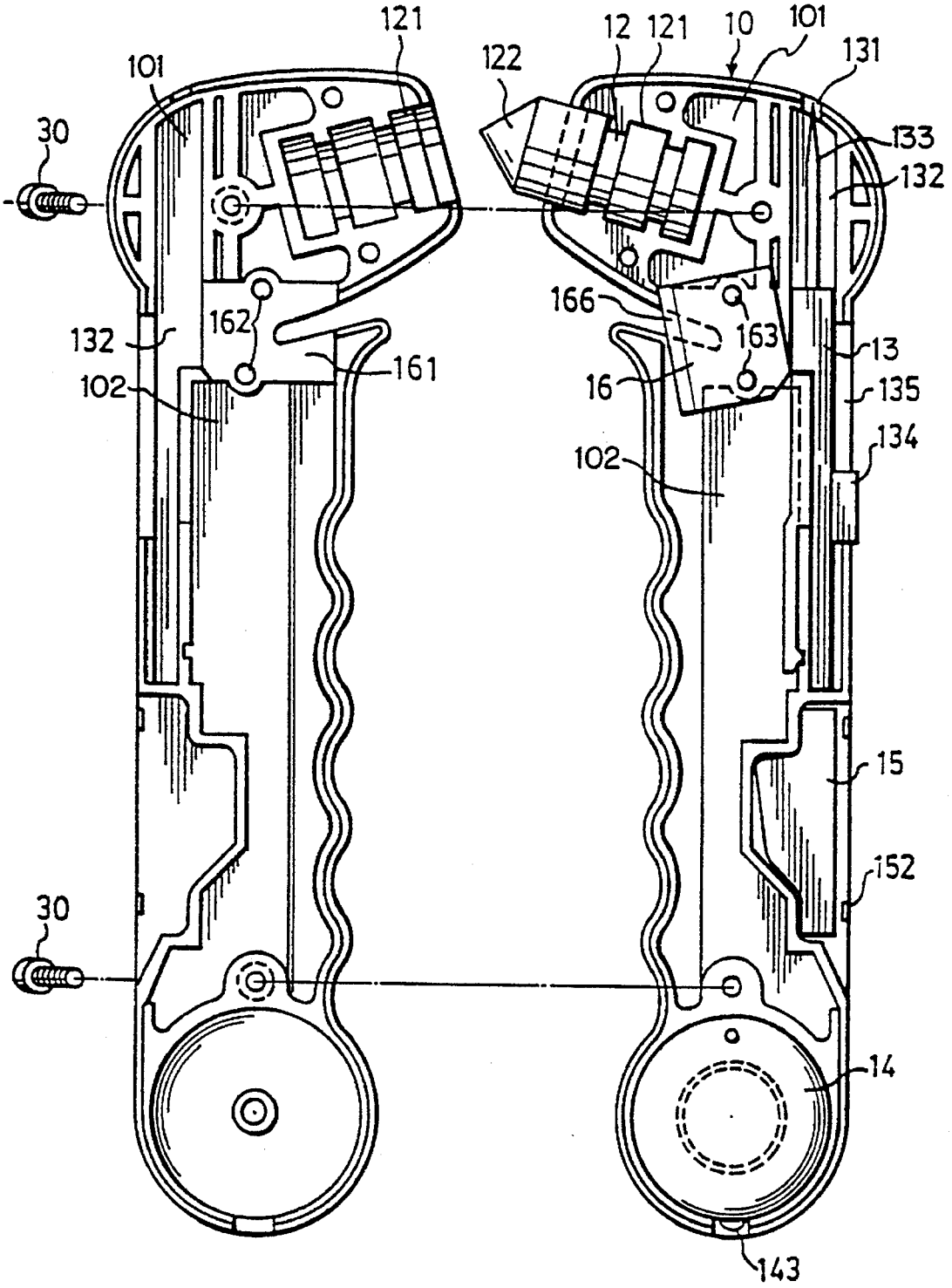
FIG. 3 is a partial exploded view of the elongated body of the emergency escape apparatus according to the present invention.
Figure 4:
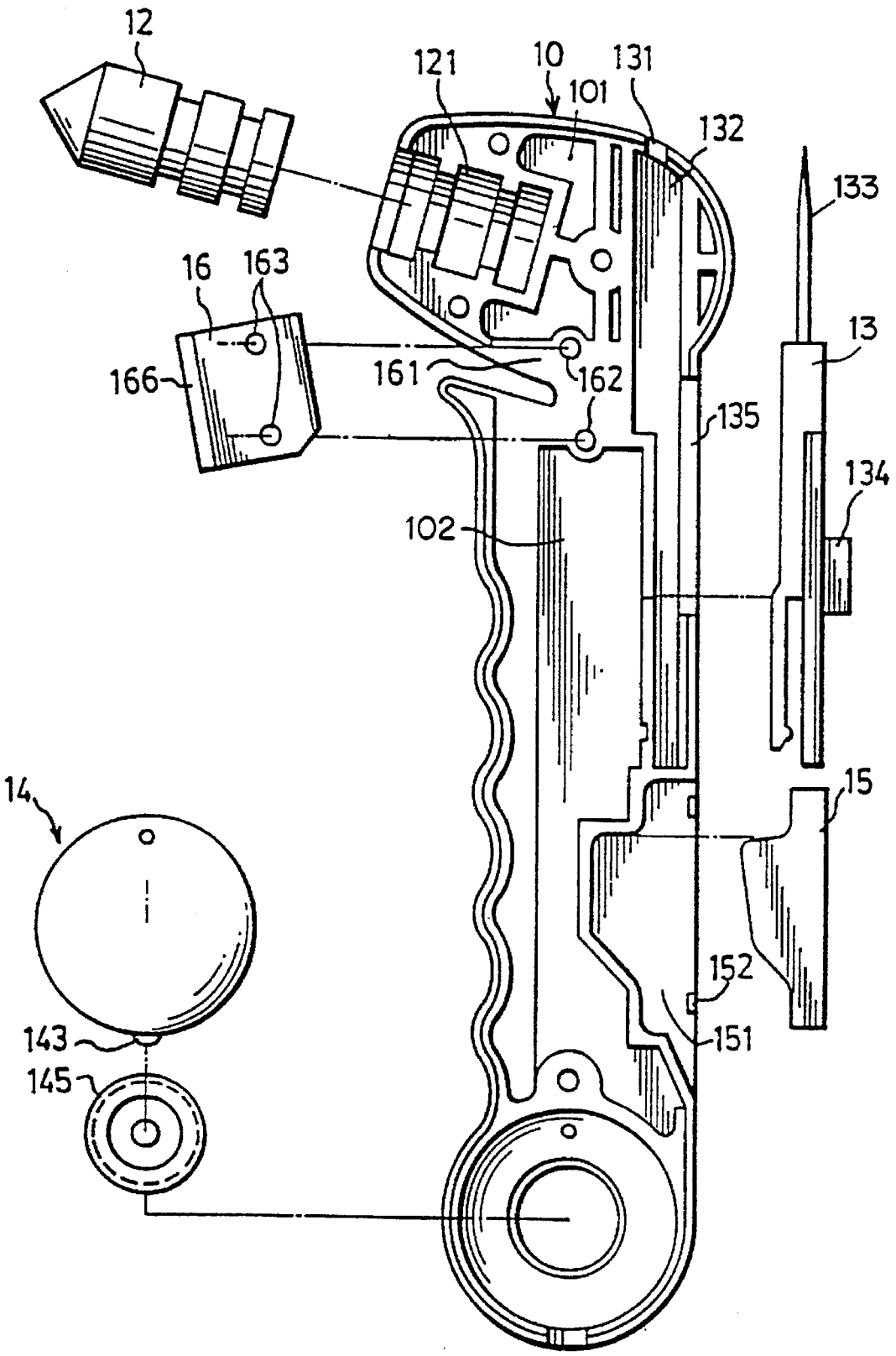
FIG. 4 is an exploded view of a half portion of the elongated body of the emergency escape apparatus according to the present invention.

Referring to FIGS. 2, 3 and 4, a receiving slot 121 is formed in the head portion 101 and a rigid striking member 12 is fixed to the receiving slot 121. The striking member 12 has a tapered end 122 which extends out of the head portion 101. The elongated body has a channel 132 which extends toward and which is communicated with the exterior of the elongated body 10 via an opening 131. A needle member 13 is received slidably in the channel 132 of the elongated body 10. The needle member 13 has a sharp end 133 which is extendible from and retractable into the elongated body 10. A groove 135 is formed in the external face of the handle portion 102 and is communicated with the channel 132. A push member 134 is connected to the needle member 13 and is slidable in the groove 135 so that the sharp end 133 of the needle member 13 can be extended out from or retracted into the elongated body 10 by pushing the push member 134 along the groove 135.

A notch 164 is formed between the head portion 101 and the handle portion 102. A blade member 16 is fixed to the elongated body 10 near the notch 164 and has a cutting edge 166 which extends into the notch 164 for cutting purposes. One half of the elongated body 10 has a recess 161 with two upright pins 162 which extend into a respective hole 163 of the blade member 16 in order to position the blade member 16 in the elongated body 10.

The handle portion 102 has a receiving hole 141 formed therein, an opening 142 which communicates the receiving hole 141 and the exterior of the elongated body 10, and an illuminating device 14 mounted in the receiving hole 141. The illuminating device 14 has a light-emitting member 143, such as a light-emitting diode which extends into the opening 142, a mercury battery 145 which is adapted to be connected electrically to the light-emitting member 143 by means of depressing a flexible press portion 144 of the handle portion 102, as best illustrated in FIG. 2.

A cavity 151 is formed in the edge of the handle portion 102 and has a whistle 15 received therein. Two pairs of resilient hooks 152 are formed at the top edge of the cavity 151 in order to retain removably the whistle 15 in a cavity.

Figure 5:
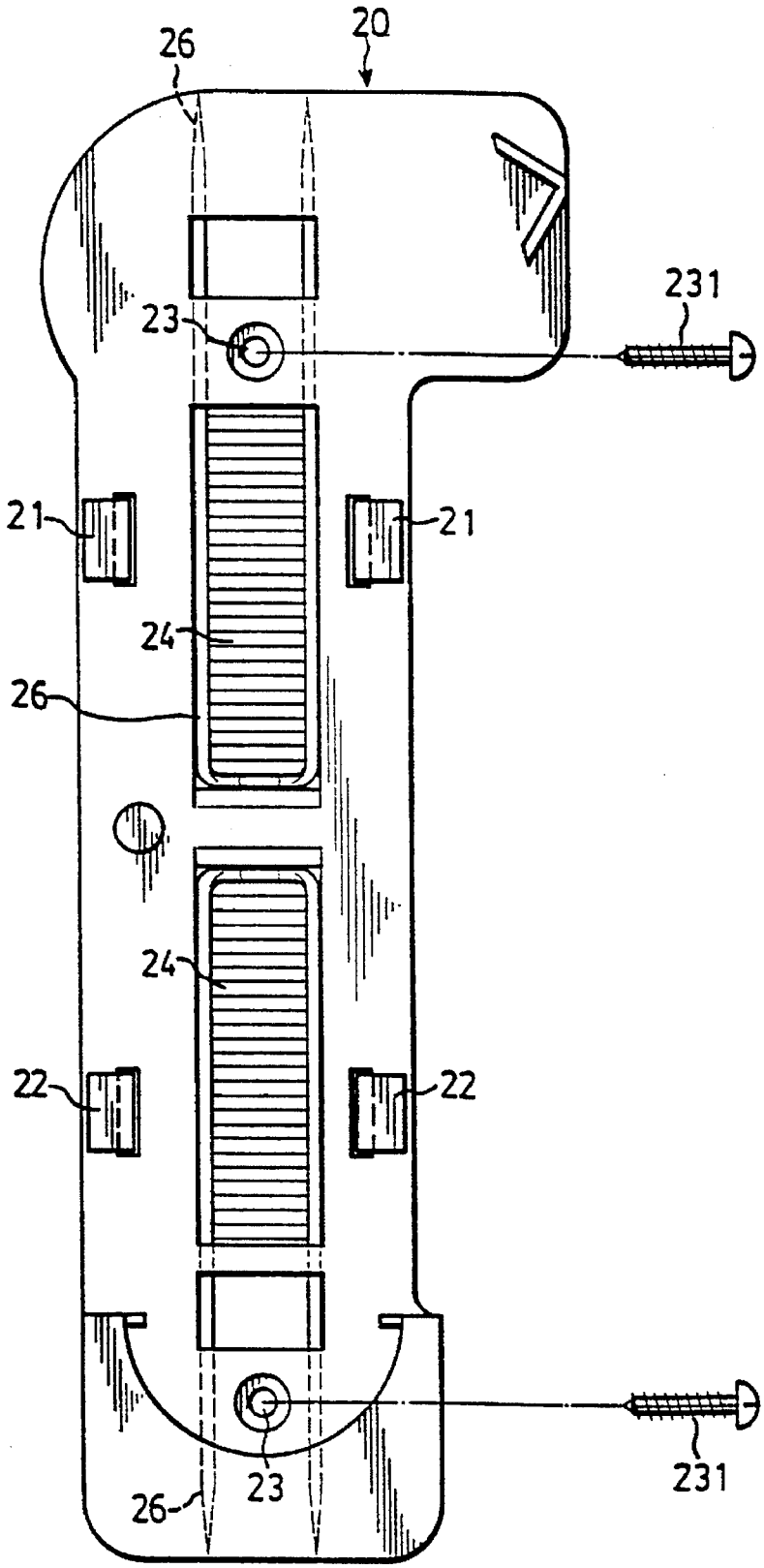
FIG. 5 is a side view of the mounting seat of the emergency escape apparatus according to the present invention.

Referring to FIGS. 1 and 5, the mounting seat 20 has two pairs of clamp members 21, 22 for positioning the elongated body 10 in the mounting seat 20. The mounting seat 20 further has a fixing unit which includes first and second fixing devices. The first fixing device includes a pair of through holes 23 and two screw members 231. The second fixing member includes a pair of U-shaped fixing pins 26 which are received slidably in two sliding grooves 24. The bottoms of the sliding grooves 24 are corrugated and taper toward two ends of the mounting seat 20 in order to engage frictionally the U-shaped pins 26. Therefore, the mounting seat 20 can be affixed to a predetermined position of the car by threading the screw members 231 through the through holes 23. Alternatively, the U-shaped pins 26 may be pushed to extend out of the ends of the mounting seat 20 and then pierce into a soft member such as the chair of the car, in order to attach the mounting seat 20 on the car.

Therefore, when an accident occurs and the driver is stuck in the car as described in the prior art, the driver may break the windows of the car by means of the striking member 12 in order to get out of the car through the windows. The driver may deflate the expanded air bag by means of the needle member 13 and cut the safety belt in order to release himself from the driver's seat. In addition, the apparatus of the present invention can be used as a flashlight due to the present of the illuminating device 14. The whistle 15 may be used to call for help.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangement.

I claim:

1. An emergency escape apparatus for use in a car, comprising:

an elongated body having a head portion and a handle portion which is connected integrally to said head portion, said elongated body having a channel which extends toward and which is communicated with an exterior of said elongated body;

a rigid striking member fixed to said head portion, said striking member having a tapered end which extends out of said head portion; and a needle member received slidably in said channel of said elongated body, said needle member having a sharp end which is extendible from and retractable into said elongated body.

2. An emergency escape apparatus as claimed in claim 1, wherein said elongated body has a groove which is formed in an external face thereof and which is communicated with said channel, and a push member which is connected to said needle member and which is slidable in said groove.

3. An emergency escape apparatus as claimed in claim 1, wherein said elongated body has a notch which is formed between said head portion and said handle portion, and a blade member which is fixed in said elongated body near said notch, said blade member having a cutting edge which extends into said notch.

4. An emergency escape apparatus as claimed in claim 1, wherein said handle portion has a receiving hole formed therein, an opening which communicates said receiving hole and said exterior of said elongated body, and an illuminating device mounted in said receiving hole, said illuminating device having a light-emitting member which extends into said opening.

5. An emergency escape apparatus as claimed in claim 2, wherein said handle portion has a cavity formed in said external face of said elongated body, and a whistle mounted removably in said cavity.

6. An emergency escape apparatus as claimed in claim 1 further comprising a mounting seat for receiving removably said handle portion therein, said mounting seat having a fixing unit for affixing said mounting seat to a predetermined position of said car.

* * * * *